US010359734B2

(12) United States Patent
Kato et al.

(10) Patent No.: US 10,359,734 B2
(45) Date of Patent: Jul. 23, 2019

(54) IMAGE FORMING APPARATUS AND IMAGE FORMING UNIT

(71) Applicant: FUJI XEROX CO., LTD., Tokyo (JP)

(72) Inventors: Nao Kato, Kanagawa (JP); Mutsumi Kikuchi, Kanagawa (JP); Kenji Hayamizu, Kanagawa (JP); Shota Makita, Kanagawa (JP); Shinichi Oba, Kanagawa (JP); Iori Togu, Kanagawa (JP)

(73) Assignee: FUJI XEROX CO., LTD., Minato-Ku, Tokyo (JP)

( * ) Notice: Subject to any disclaimer, the term of this patent is extended or adjusted under 35 U.S.C. 154(b) by 5 days.

(21) Appl. No.: 15/483,053

(22) Filed: Apr. 10, 2017

(65) Prior Publication Data

US 2017/0307998 A1 Oct. 26, 2017

(30) Foreign Application Priority Data

Apr. 20, 2016 (JP) ..... 2016-084468
Oct. 27, 2016 (JP) ..... 2016-210200

(51) Int. Cl.
*G03G 21/18* (2006.01)

(52) U.S. Cl.
CPC ..... *G03G 21/1825* (2013.01)

(58) Field of Classification Search
CPC ..... G03G 15/065
See application file for complete search history.

(56) References Cited

U.S. PATENT DOCUMENTS 6,044,235 A * 3/2000 Hashimoto ..... G03G 21/1814 399/111
7,194,225 B2 * 3/2007 Yamaguchi ..... G03G 21/1825 399/111
2014/0314439 A1 * 10/2014 Yasui ..... G03G 15/0898 399/103

FOREIGN PATENT DOCUMENTS

JP 2006-330676 A 12/2006
JP 2010-250093 A 11/2010

* cited by examiner

*Primary Examiner* — David M. Gray
*Assistant Examiner* — Michael A Harrison
(74) *Attorney, Agent, or Firm* — Sughrue Mion, PLLC

(57) ABSTRACT

An image forming apparatus includes an image carrier, a developing roller, a biasing member, and a fluctuation preventing member. A latent image is formed on the image carrier. The developing roller is provided to face the image carrier and develops the latent image on the image carrier. The biasing member is provided on an outside of an end portion of the developing roller and biases the image carrier and the developing roller in a direction where the image carrier and the developing roller approach each other. The fluctuation preventing member is interposed between the image carrier and the developing roller and prevents, along with the biasing member, a fluctuation in a distance between a surface of the developing roller and a surface of the image carrier in a region where the image carrier and the developing roller face each other.

12 Claims, 13 Drawing Sheets

IMAGE FORMING APPARATUS AND IMAGE FORMING UNIT

CROSS-REFERENCE TO RELATED APPLICATIONS

This application is based on and claims priority under 35 USC 119 from Japanese Patent Application No. 2016-210200 filed Oct. 27, 2016, which claims priority from Japanese Patent Application No. 2016-884468 filed Apr. 20, 2016.

BACKGROUND

Technical Field

The present invention relates to an image forming apparatus and an image forming unit.

SUMMARY

According to an aspect of the invention, an image forming apparatus includes an image carrier, a developing roller, a biasing member, and a fluctuation preventing member. A latent image is formed on the image carrier. The developing roller is provided to face the image carrier and develops the latent image on the image carrier. The biasing member is provided on an outside of an end portion of the developing roller and biases the image carrier and the developing roller in a direction where the image carrier and the developing roller approach each other. The fluctuation preventing member is interposed between the image carrier and the developing roller and prevents, along with the biasing member, a fluctuation in a distance between a surface of the developing roller and a surface of the image carrier in a region where the image carrier and the developing roller face each other.

BRIEF DESCRIPTION OF THE DRAWINGS

Exemplary embodiments of the present invention will be described in detail based on the following figures, wherein.

DETAILED DESCRIPTION

Next, an exemplary embodiment of the present invention will be described in detail with reference to the drawings.

Figure 1:
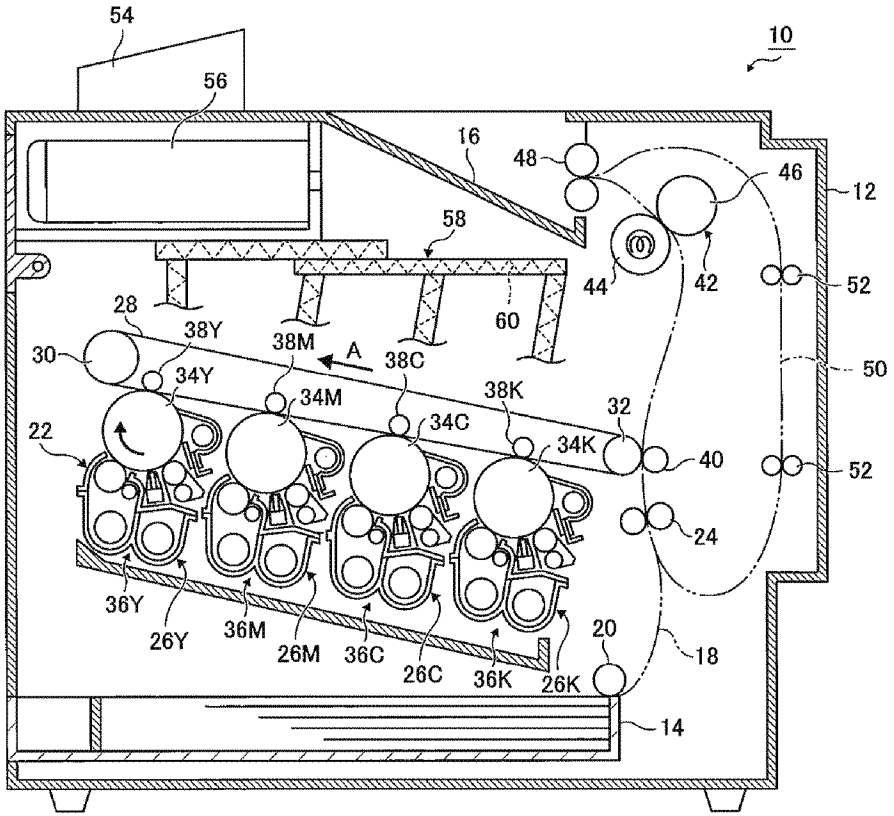
FIG. 1 is a cross-sectional view illustrating an image forming apparatus of an exemplary embodiment of the present invention when viewed from the front side.

FIG. 1 is a view illustrating a configuration of an image forming apparatus 10 of the exemplary embodiment of the present invention.

The image forming apparatus 10 has an image forming apparatus main body 12. A sheet accommodating unit 14 is provided at a lower side of the image forming apparatus main body 12, and a sheet discharge unit 16 is provided at an upper side of the image forming apparatus main body 12. Multiple sheets are accommodated in the sheet accommodating unit 14. A sheet path 18 is formed from the sheet accommodating unit 14 to the sheet discharge unit 16.

A sheet disposed at an uppermost position of the sheet accommodating unit 14 is sent by a pickup roller 20. The sent sheet is temporarily stopped, positioned, and regulated by registration rollers 24, and transported, at a predetermined timing, toward a secondary transfer roller 40 to be described below.

An image forming section 22 is provided at a central portion of the image forming apparatus main body 12. For example, the image forming section 22 has four image forming units 26Y, 26M, 26C, and 26K. The image forming units 26Y, 26M, 26C, and 26K are provided to correspond to respective colors including yellow (Y), magenta (M), cyan (C), and black (K), respectively, and arranged at a constant interval along an intermediate transfer belt 28. For example, the intermediate transfer belt 28 is supported by two support rollers 30 and 32, and rotates in a direction indicated by the arrow A.

The image forming units 26Y, 26M, 26C, and 26K are detachable from the image forming apparatus main body 12. The image forming units 26Y, 26M, 26C, and 26K may be detached from the image forming apparatus main body 12 by, for example, being drawn toward a front side (a front side of the sheet surface of FIG. 1), or may be mounted to the image forming apparatus main body 12 by, for example, being pushed toward a rear side (an inner side of the sheet surface of FIG. 1).

The image forming units 26Y, 26M, 26C, and 26K have photoconductive drums 34Y, 34M, 34C, and 34K, which are image carriers on which latent images are formed, and developing devices 36Y, 36M, 36C, and 36K, respectively. The photoconductive drums 34Y, 34M, 34C, and 34K face primary transfer rollers 38Y, 38M, 38C, and 38K, respectively, with the intermediate transfer belt 28 interposed therebetween. Developer images formed by the image forming units 26Y, 26M, 26C, and 26K are primarily transferred to the intermediate transfer belt 28 by the primary transfer rollers 38Y, 38M, 38C, and 38K.

The secondary transfer roller 40 faces the support roller 32 with the intermediate transfer belt 28 interposed therebetween. The primarily transferred developer image is secondarily transferred, by the secondary transfer roller 40, to the sheet transported through the sheet path 18.

The sheet to which the developer is secondarily transferred is transported to a fixing device 42. The fixing device 42 is a device for fixing the toner image, which is transferred to the sheet, onto the sheet by using, for example, heat and pressure. The fixing device 42 has, for example, a heating roller 44 and a pressure roller 46. The sheet, to which the developer image is fixed by the fixing device 42, is discharged to the sheet discharge unit 16 by discharge rollers 48.

The image forming apparatus 10 has a reverse transport path 50. The reverse transport path 50 is a transport path for transporting the sheet, which has one surface on which the developer image is formed, to an upstream side of the registration rollers 24 in the sheet path 18 while reversing the sheet. For example, two transport rollers 52 and 52 are disposed along the reverse transport path 50, and the sheet, which is sent from the discharge rollers 48 to the reverse transport path 50, is transported to the sheet path 18 by the transport rollers 52 and 52.

For example, a UI device 54 is provided at the upper side of the image forming apparatus main body 12. For example, the UI device 54 is configured by a combination of a liquid crystal display device and a touch panel type information input device. The UI device 54 allows an operator to input setting information for forming an image, and displays information to the operator.

The image forming apparatus 10 has developer containers 56. The number of developer containers 56 corresponds to the number of developing devices 36Y, 36M, 36C, and 36K. The developer (toner) is accommodated in the developer container 56. For example, the developer container 56 is detachably mounted to the image forming apparatus main body 12 at the upper side of the image forming apparatus main body 12.

A developer transport device 58 transports the developer of each color, which is accommodated in the developer container 56, to each of the corresponding developing devices 36Y, 36M, 36C, and 36K. A transport member 60, which is formed in a spiral shape, is provided in the developer transport device 58, and the developer is transported to each of the developing devices 36Y, 36M, 36C, and 36K from the developer container 56 by rotating the transport member 60.

Figure 2:
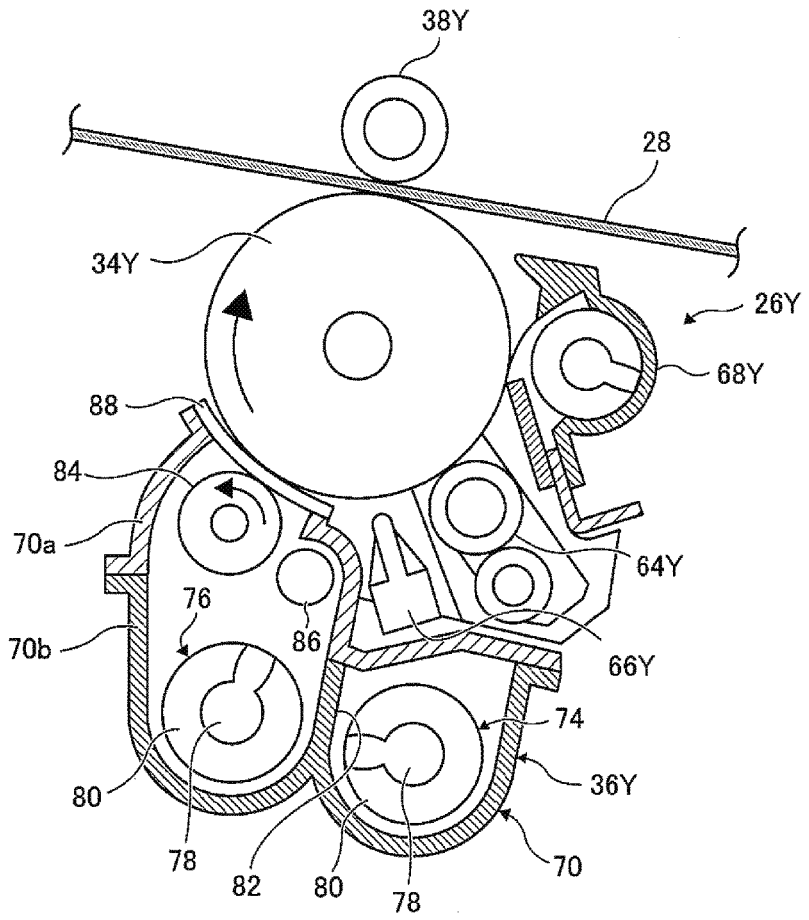
FIG. 2 is a cross-sectional view illustrating an image forming unit used in the exemplary embodiment of the present invention when viewed from the front side.

FIG. 2 illustrates the image forming unit 26Y for yellow, as an example of the image forming unit. Further, because the other image forming units 26M, 26C, and 26K have the same configuration as the image forming unit 26Y, a description thereof will be omitted.

In addition to the photoconductive drum 34Y and the developing device 36Y, the image forming unit 26Y has a charging device 64Y which charges the photoconductive drum 34Y, a latent image forming device 66Y which forms a latent image on a surface of the photoconductive drum 34Y by emitting light onto the surface of the photoconductive drum 34Y which is charged by the charging device 64Y, and a cleaning device 68Y which cleans the photoconductive drum 34Y by removing the toner or the like remaining on the photoconductive drum 34Y after the toner image is transferred to the intermediate transfer belt 28 by the primary transfer roller 38Y.

The developing device 36Y is a two-component developing device which develops an image by using the toner and a carrier. The developing device 36Y has a developing roller 84 and a developing roller side housing 70. The developing roller side housing 70 is used as a housing which surrounds the developing roller 84, and configured by joining an upper member 70*a* and a lower member 70*b*. In addition, a developer circulation path 72 is formed at a lower side of the developing roller side housing 70.

A first developer transport member 74 and a second developer transport member 76 are disposed in the developer circulation path 72. Each of the first developer transport member 74 and the second developer transport member 76 includes a rotating shaft 78, and a spiral agitation transport unit 80 formed around the rotating shaft 78. In addition, the first developer transport member 74 and the second developer transport member 76 are spaced apart from each other by a partition wall portion 82 formed in a central longitudinal direction. Openings (not illustrated) are formed at both sides of the partition wall portion 82 in a longitudinal direction. The developer circulates in the developer circulation path 72 through the openings.

A developer supply port (not illustrated), which is connected to the developer circulation path 72, is formed in the developing roller side housing 70. New toner is supplied from the developer supply port through the developer transport device 58 from the developer container 56.

The developing roller 84 is formed in the form of a hollow metallic cylinder, and is disposed to face a fluctuation preventing member 88 interposed between the photoconductive drum 34Y and the developing roller 84. The developing roller 84 develops the latent image on the photoconductive drum 34Y.

The fluctuation preventing member 88 is interposed between the photoconductive drum 34Y and the developing roller 84. Further, details of the fluctuation preventing member 88 will be described below.

A layer thickness regulating member 86 is provided at an upstream side in a developing region facing the photoconductive drum 34Y. The layer thickness regulating member 86 regulates a layer thickness of a magnetic brush formed on the developing roller 84. Further, the developer of which the layer thickness is regulated by the layer thickness regulating member 86 is supplied to the developing region, such that the toner image is formed on the photoconductive drum 34Y.

Figure 3:
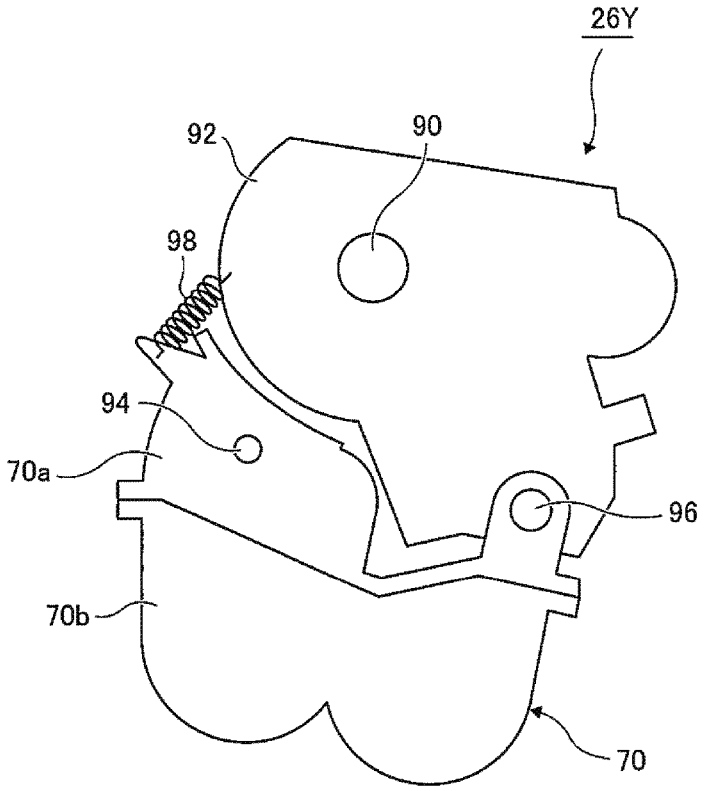
FIG. 3 is a front view illustrating the image forming unit used in the exemplary embodiment of the present invention.

FIG. 3 is a front view illustrating the image forming unit 26Y.

The image forming unit 26Y further has a photoconductive drum side housing 92 in addition to the aforementioned respective members. In addition, the photoconductive drum 34Y has a drum rotating shaft 90. The photoconductive drum 34Y is rotatably supported on the photoconductive drum side housing 92 through the drum rotating shaft 90. In addition, the developing roller 84 has a roller rotating shaft 94. The developing roller 84 is rotatably supported on the upper member 70*a* of the developing roller side housing 70 through the roller rotating shaft 94.

The photoconductive drum side housing 92 is used as not only a housing which surrounds the photoconductive drum 34Y, but also an image carrier side housing which surrounds the photoconductive drum 34Y.

The developing roller side housing 70 and the photoconductive drum side housing 92 are rotatably supported by a support shaft 96. The support shaft 96 is provided to be biased to one side of the developing roller side housing 70 and the photoconductive drum side housing 92. For example, biasing members 98 are compression coil springs. The biasing members 98 are provided at both sides in an axial direction at the other side of the developing roller side housing 70 and the photoconductive drum side housing 92. The biasing members 98 bias the developing roller side housing 70 and the photoconductive drum side housing 92 in a direction in which the developing roller side housing 70 and the photoconductive drum side housing 92 are attracted. That is, the biasing member 98 biases the photoconductive drum 34Y and the developing roller 84 in a direction in which the photoconductive drum 34Y and the developing roller 84 approach each other.

As described above, in the exemplary embodiment, the image forming unit 26Y has the biasing member 98. The biasing member 98 is provided in the image forming unit 26Y. For this reason, an operation of attaching or detaching the image forming unit 26Y to or from the image forming apparatus main body 12 is simple in comparison with a case in which, for example, the biasing member 98 is provided at a position other than the image forming unit 26Y of the image forming apparatus main body 12 and the like.

Next, the fluctuation preventing member 88 will be described in detail.

Figure 4:
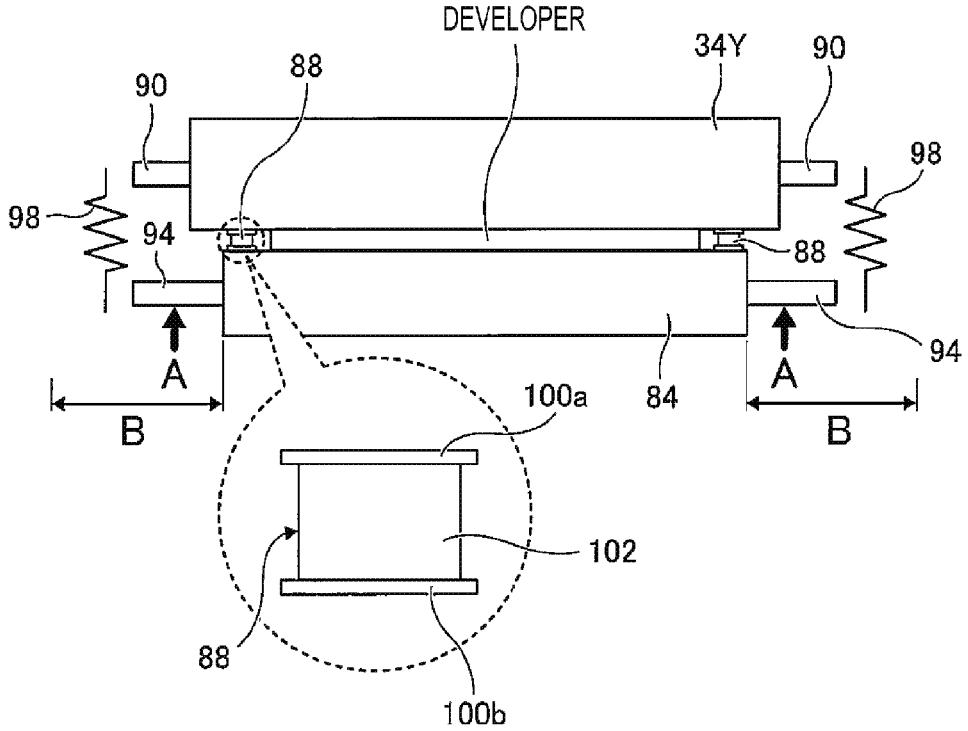
FIG. 4 is a top plan view illustrating a relationship among an image carrier, a developing device, biasing members, and a fluctuation preventing member which are used in the exemplary embodiment of the present invention.

In FIG. 4, the fluctuation preventing members 88 are provided at the opposite end portions of the photoconductive drum 34Y and the developing roller 84. The opposite end portions of the developing roller 84 are non-developing portions where no magnet is disposed, and the fluctuation preventing members 88 are disposed at the non-developing portions, respectively. The inner side between the fluctuation preventing members 88 is a developing portion (nip portion) where a magnet is provided, and a magnetic brush of the developer is formed in the developing portion such that a latent image on the photoconductive drum is developed with the toner.

Figure 5:
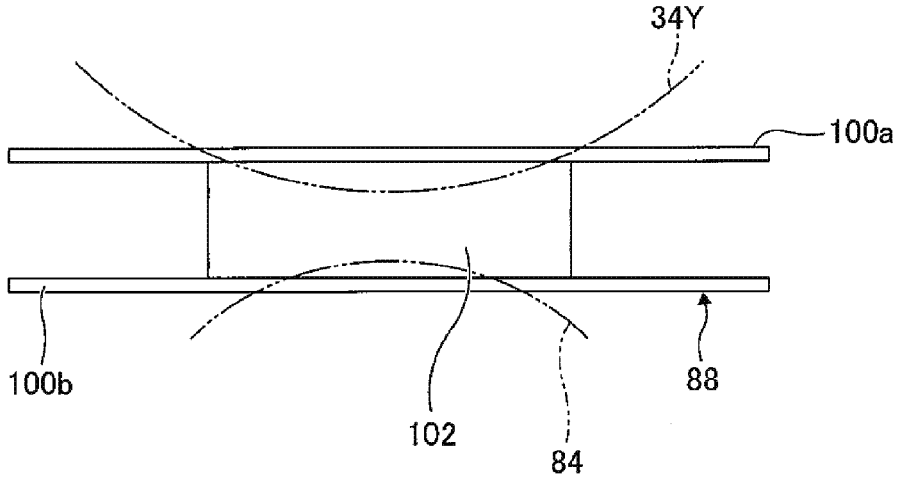
FIG. 5 is a view illustrating the fluctuation preventing member used in the exemplary embodiment of the present invention when viewed from the front side.

As illustrated in FIG. 5, the fluctuation preventing members 88 are disposed to be interposed between the photoconductive drum 34Y and the developing roller 84, and formed in an elongated band shape. In addition, each fluctuation preventing member 88 includes a first sliding portion 100*a* formed of a sheet so that the photoconductive drum 34Y slides on the first sliding portion 100*a*, a second sliding portion 100*b* formed of a sheet so that the developing roller 84 slides on the second sliding portion 100*b*, and a main body portion 102 disposed to be interposed between the first sliding portion 100*a* and the second sliding portion 100*b*. Each of the first sliding portion 100*a* and the second sliding portion 100*b* has a slightly larger area than the main body portion 102. The first sliding portion 100*a* is mounted on one end portion of the main body portion 102, and the second sliding portion 100*b* is mounted on the other end portion of the main body portion 102.

In the exemplary embodiment, each fluctuation preventing member 88 has two sliding portions including the first sliding portion 100*a* and the second sliding portion 100*b*. However, the fluctuation preventing member 88 may be configured to have any one of the first sliding portion 100*a* and the second sliding portion 100*b*.

As illustrated in FIG. 2, the opposite ends of the fluctuation preventing member 88 in a rotation direction of the photoconductive drum 34Y or a rotation direction of the developing roller 84 are fixed to the developing roller side housing 70. Further, the fluctuation preventing member 88 may be fixed to the photoconductive drum side housing 92 instead of the developing roller side housing 70, or may be fixed by being interposed between the developing roller side housing 70 and the photoconductive drum side housing 92. In addition, the opposite ends of the fluctuation preventing member 88 may not be fixed, and only the upstream side of the fluctuation preventing member 88 in the rotation direction of the photoconductive drum 34Y or the rotation direction of the developing roller 84 may be fixed.

The biasing members 98 bias the photoconductive drum 34Y and the developing roller 84 in the direction in which the photoconductive drum 34Y and the developing roller 84 are attracted to each other. Alternatively, the biasing members 98 may be disposed in a compressed state so as to press in the direction from the developing roller 84 to the photoconductive drum 34Y as indicated by the arrows A in FIG. 4.

As illustrated in FIG. 4, the biasing members 98 are disposed in regions B on the outside of the end portions of the developing roller 84. For example, in a case where a pressing pressure is intended to be applied, by the biasing members, to the developing roller 84 from the surface of the developing roller 84 opposite to the surface of the developing roller 84 which faces the photoconductive drum 34Y, there is a concern that deflections of the opposite surfaces may have an influence on deflections in the nip region between the photoconductive drum 34Y and the developing roller 84. In order to avoid this influence, the biasing members 98 are disposed as described above.

The first sliding portion 100*a* and the second sliding portion 100*b* are made of a material having low frictional resistance. For example, the material contains at least one of polyimide, polyethylene terephthalate, polyoxymethylene resin, and polyacetal resin. In addition, the main body portion 102 is made of a viscoelastic material. For example, the material contains at least one of ether-based polyurethane, styrene-based thermoplastic elastomer, olefin-based thermoplastic elastomer, and urethane-based macrofoam.

As illustrated in FIG. 5, in the developing s, the main body portion 102 is interposed between the photoconductive drum 34Y and the developing roller 84 in a compressed state, and the main body portion 102 is deformed so as to change a compression ratio.

Next, an operation of the fluctuation preventing members 88 will be described.

Figure 6A:
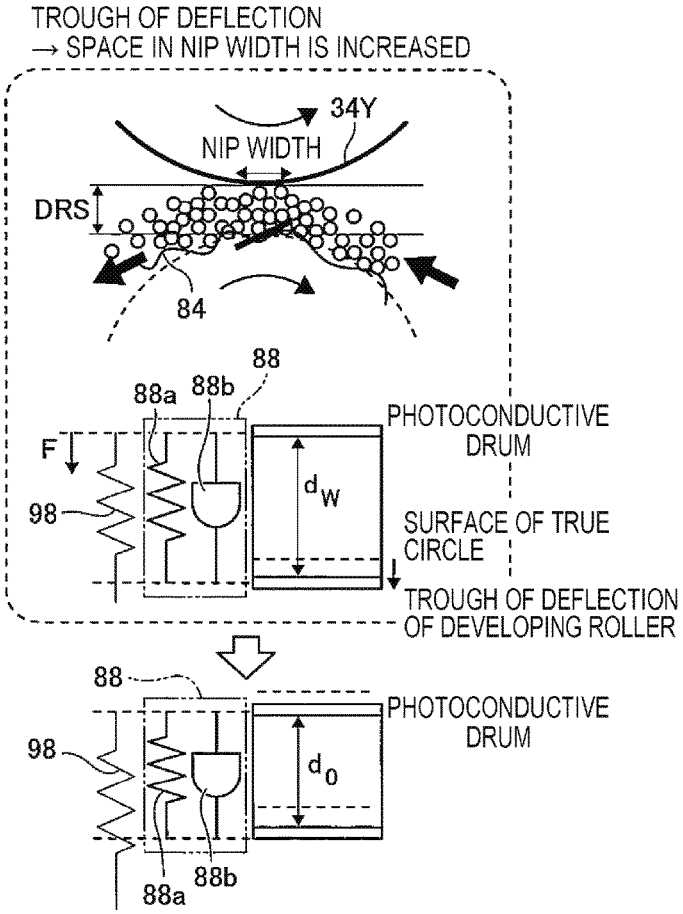
FIGS. 6A and 6B are explanatory views for explaining an operation according to the exemplary embodiment of the present invention.
Figure 6B:
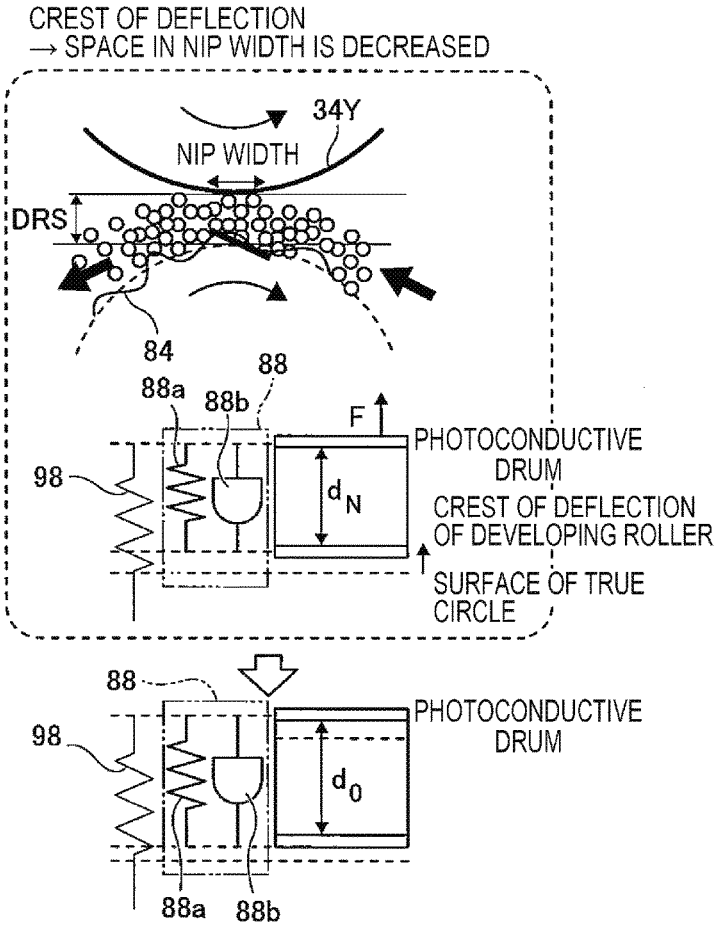

As illustrated in FIGS. 6A and 6B, the developing roller 84 has deflections that deviate from a true circle indicated by a dotted line. For example, in FIG. 6A, in a space in a nip width, a trough of the deflection is present where a distance (hereinafter, referred to as a "DRS") between the photoconductive drum 34Y and the developing roller 84 is gradually increased. In FIG. 6B, a crest of the deflection is present where the DRS is gradually decreased.

In addition, each fluctuation preventing member 88 is considered as a combination of an elastic element 88*a* and a viscous element 88*b*.

Here, in the case of the trough of the deflection as illustrated in FIG. 6A, the DRS is gradually increased, and as a result, the magnetic brush in the nip width gradually becomes coarse. When the magnetic brush gradually becomes coarse, the pressing force of the magnetic brush which presses the photoconductive drum 34Y is gradually weakened. In addition, the compression ratio of the fluctuation preventing member becomes low, and as a result, repulsive force becomes low. The photoconductive drum 34Y is pulled toward the developing roller 84 by force F in a direction where the DRS of the biasing members 98 is decreased, and the repulsive force of the fluctuation preventing members 88 and the elastic force of the magnetic brush (MOS) act as resistance such that the DRS is adjusted to a DRS (d0) balanced with the biasing force of the biasing members 98.

Meanwhile, in the case of the crest of the deflection as illustrated in FIG. 6B, the DRS is gradually decreased, and as a result, the magnetic brush in the nip width gradually becomes dense. When the magnetic brush gradually becomes dense, the pressing force of the magnetic brush which presses the photoconductive drum 34Y is gradually strengthened. In addition, the compression ratio of the fluctuation preventing member becomes high, and as a result, the repulsive force becomes high. The photoconductive drum 34Y is pulled to be separated from the developing roller 84 by force F in a direction where the DRS of the biasing members 98 is increased, but the repulsive force of the fluctuation preventing members 88 and the elastic force of the magnetic brush (MOS) act as resistance such that the DRS is adjusted to the DRS (d0) balanced with the biasing force of the biasing members 98.

As described above, the fluctuation preventing member 88 is interposed between the photoconductive drum 34Y and the developing roller 84. Along with the biasing member 98, the fluctuation preventing member 88 prevents a fluctuation in the DRS in a region where the photoconductive drum 34Y and the developing roller 84 face each other.

Next, an example will be described.

The image forming apparatus used in the example has the following specifications.

Print speed: 35 ppm

Process speed: 216 mm/s

Diameter of photoconductive drum: ϕ24

Diameter of developing roller: ϕ16

Weight of developing device with photoconductive drum being fixed to image forming apparatus main body: 225 g Maximum value of deflection of developing roller: 26 μm Elastic modulus of biasing member: 1600 N/mm Area of main body portion of fluctuation preventing member: 5 mm×10 mm Thickness of main body portion of fluctuation preventing member: 0.5 mm (when having a free form, the main body portion is compressed at the time of being inserted)

Material of sliding portion of fluctuation preventing member: polyimide

Thickness of sliding portion of fluctuation preventing member: 50 mm

In the above specifications, ΔE was measured by changing the material of the main body portion of the fluctuation preventing member to PET (polyethylene terephthalate resin), polyurethane resin, PORON (urethane resin), polyimide resin, and Sorbothane.

Here, ΔE (color difference) refers to a quantitative value of a development property fluctuation width in a color space, and specifically, ΔE refers to density unevenness in a sub-scanning direction when the printing is performed on a sheet.

Figure 7:
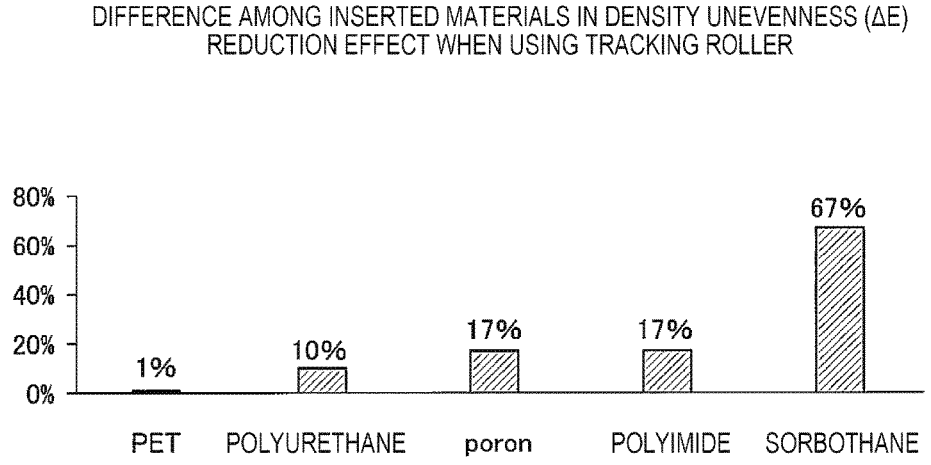
FIG. 7 is a graph illustrating a ΔE reduction effect when comparing an example of the present invention with a comparative example.

FIG. 7 illustrates a ΔE reduction effect of a developing roller cycle in a case where a tracking roller is used without using the fluctuation preventing member according to the present invention.

Polyurethane resin, PORON (urethane resin), and polyimide resin, ΔE reduction effect of which is 10% or higher, may be used, and Sorbothane has the maximum ΔE reduction effect of 67%.

Figure 8:
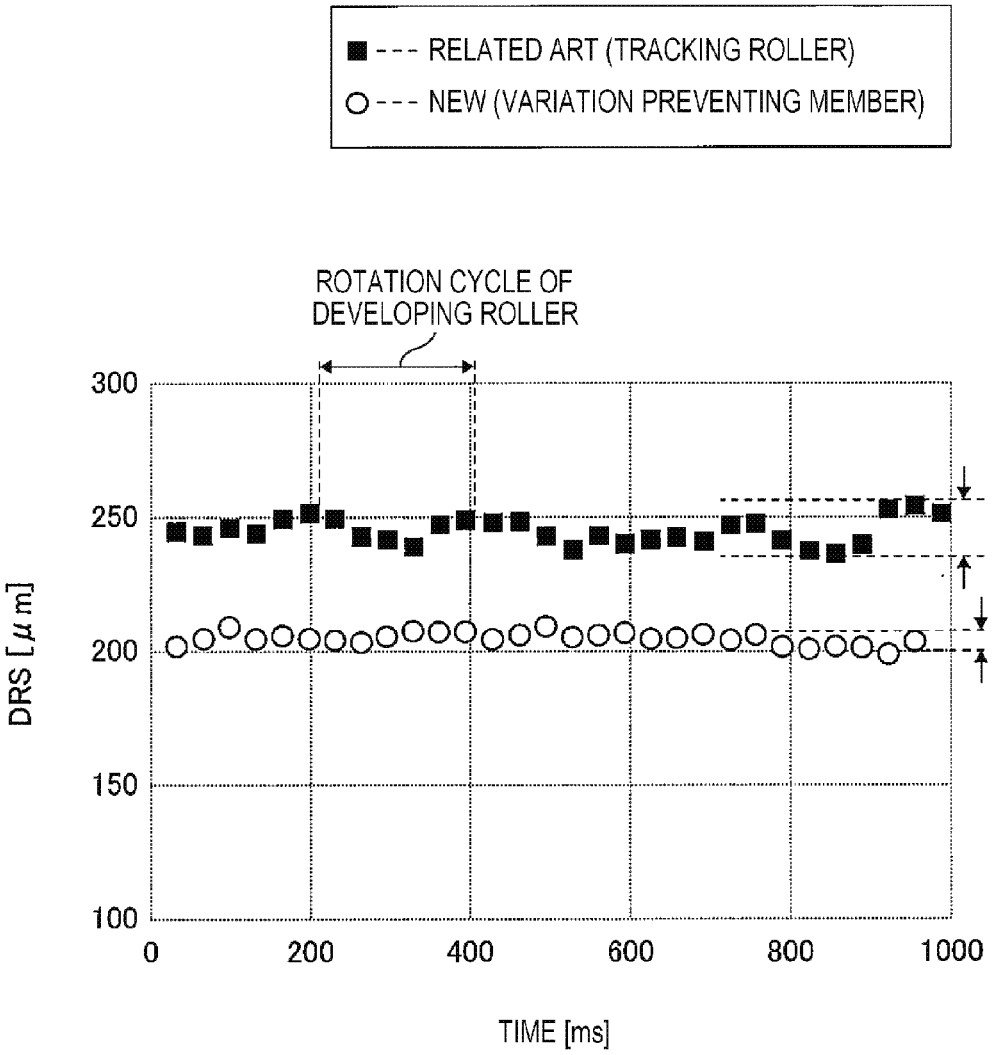
FIG. 8 is a graph illustrating a result of measuring changes in DRS with respect to time when comparing the example of the present invention with the comparative example.

FIG. 8 illustrates a result of measuring a change in DRS with respect to time. In the case of the example, DRS amplitude may be decreased compared with the case in which the tracking roller is used.

Figure 9:
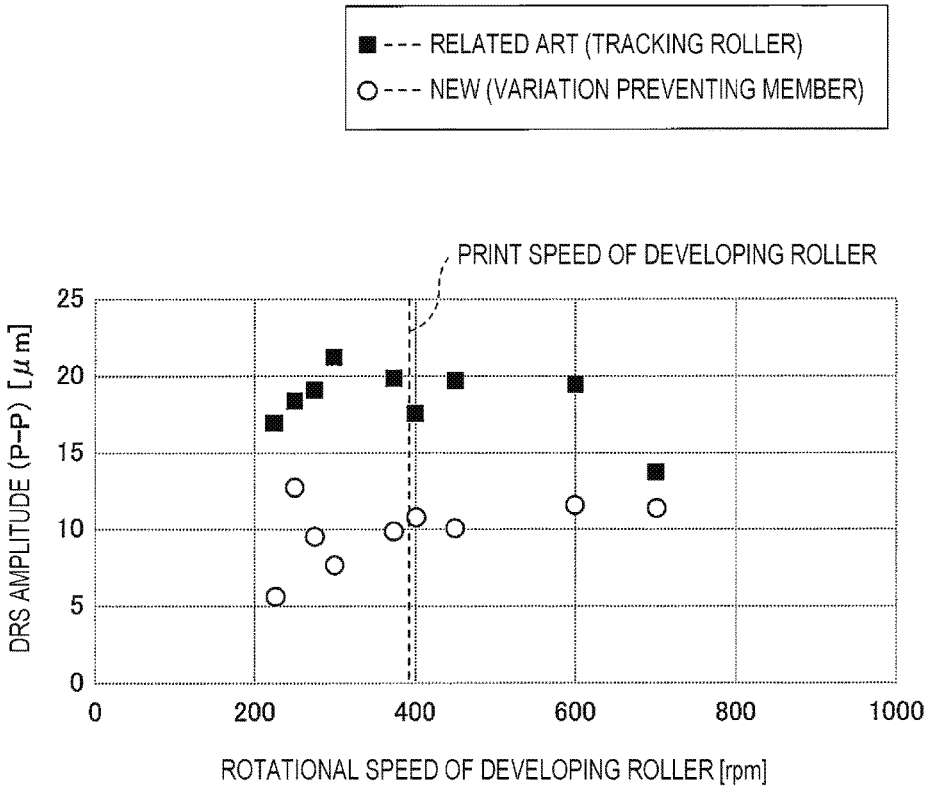
FIG. 9 is a graph illustrating a result of measuring DRS amplitude when changing a developing roller rotational speed when comparing the example of the present invention with the comparative example.

FIG. 9 illustrates a result of measuring DRS amplitude (peak to peak) in a case where a rotational speed of the developing roller is changed. In the case of the example, the DRS amplitude may be decreased by the viscous element of the fluctuation preventing member compared with the case in which the tracking roller is used. In this example, the rotational speed of the developing roller is about 400 rpm, and in this region of the rotational speed, the DRS amplitude is particularly decreased. In some cases, the local maximum and minimum points of the amplitude may be present at a rotational speed of the developing roller in the vicinity of natural frequency determined by a mechanical element that sets the DRS, but the local maximum and minimum points may be shifted by the elastic element of the fluctuation preventing member.

With these effects, the specifications of the fluctuation preventing member may be selected in such a manner that the DRS amplitude is decreased at the print speed of the developing roller.

Next, the first modified example of the present invention will be described.

Figure 10:
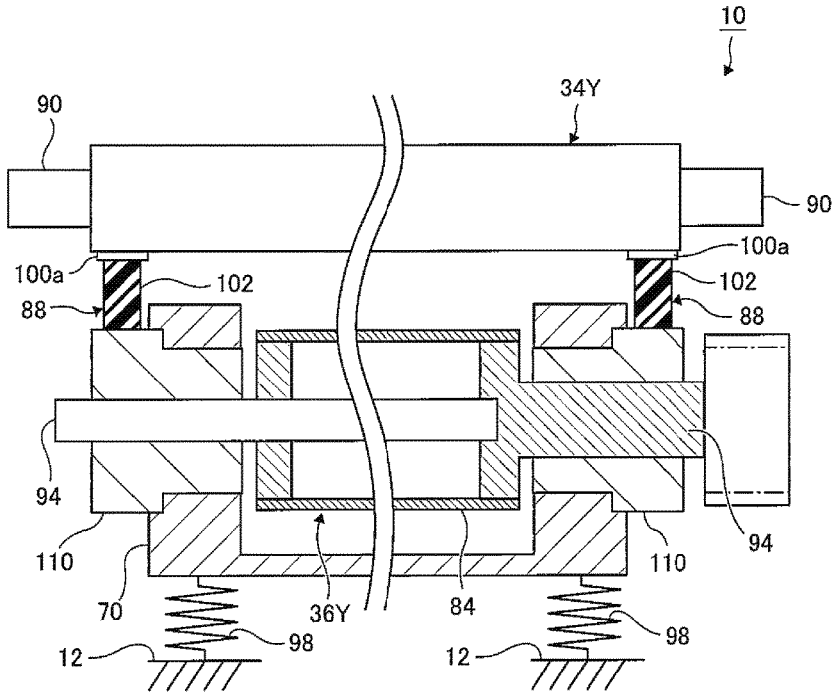
FIG. 10 is a partial cross-sectional view illustrating a relationship among an image carrier, a developing device, biasing members, and a fluctuation preventing member, which are used in a first modified example of the present invention, when viewed from the right side.

FIG. 10 is a partial cross-sectional view illustrating the photoconductive drum 34Y, the developing device 36Y, the biasing members 98, the fluctuation preventing members 88, and the like which are used in the first modified example of the present invention when viewed from the right side.

In the above exemplary embodiment, the fluctuation preventing members 88 are disposed to be interposed between the photoconductive drum 34Y and the developing roller 84 (see FIG. 4). In contrast, in the first modified example, the image forming apparatus 10 has bearings 110 that rotatably support the developing roller 84, and the fluctuation preventing members 88 are disposed to be interposed between the photoconductive drum 34Y and the bearings 110. That is, each of the fluctuation preventing members 88 is disposed at a position more distant from the developing region (the developing portion where the magnet is provided) of the developing roller 84 compared with the above-described exemplary embodiment.

One bearing 110 is provided at each of the opposite end sides in a longitudinal direction of the developing roller 84, the outer circumferential surface of each bearing 110 is fixed to the developing roller side housing 70, and the inner circumferential surface of each bearing, which is formed of a sliding surface, rotatably supports the roller rotating shaft 94 of the developing roller 84. As the bearings 110, ball bearings may be used instead of using bearings (sliding bearings) each having an inner circumferential surface that is formed of a sliding surface.

One end portion of the main body portion 102 of each fluctuation preventing member 88 is fixed to the bearing 110, the first sliding portion 100*a* is mounted to the other end portion of the main body portion 102, and the first sliding portion 100*a* is in contact with the photoconductive drum 34Y.

In the above exemplary embodiment, one end portion of each biasing member 98 is mounted to the developing roller side housing 70, the other end portion of the biasing member 98 is mounted to the photoconductive drum side housing 92, and the biasing member 98 biases the developing roller 84 mounted to the developing roller side housing 70 and the photoconductive drum 34Y mounted to the photoconductive drum side housing 92 in such a manner that the developing roller 84 and the photoconductive drum 34Y approach each other.

In contrast, in the first modified example, one end portion of each biasing member 98 is mounted to the developing roller side housing 70, the other end portion of the biasing member 98 is in contact with the image forming apparatus main body 12, and the biasing member 98 biases the developing roller side housing 70 against the photoconductive drum 34Y in such a manner that the developing roller 84 and the photoconductive drum 34Y approach each other. The other end portion of the biasing member 98 may be mounted to the image forming apparatus main body 12, and one end portion of the biasing member 98 may be in contact with the developing roller side housing 70, instead of the configuration in which one end portion of the biasing member 98 is mounted to the developing roller side housing 70, and the other end portion of the biasing member 98 is in contact with the image forming apparatus main body 12.

Because configurations of the first modified example, except for the above-described configurations, are similar to those in the above-described exemplary embodiment, descriptions of parts similar to those in the above-described exemplary embodiment will be omitted.

Next, a second modified example of the present invention will be described.

Figure 11:
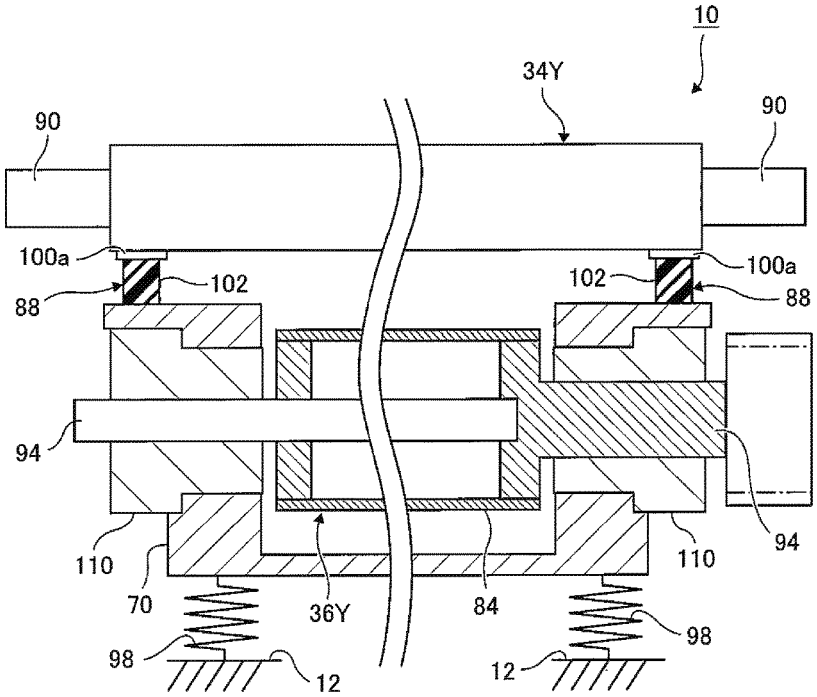
FIG. 11 is a partial cross-sectional view illustrating a relationship among an image carrier, a developing device, biasing members, and a fluctuation preventing member, which are used in a second modified example of the present invention, when viewed from the right side.

FIG. 11 is a partial cross-sectional view illustrating the photoconductive drum 34Y, the developing device 36Y, the biasing members 98, the fluctuation preventing members 88, and the like which are used in the second modified example of the present invention when viewed from the right side.

In the above exemplary embodiment, the fluctuation preventing members 88 are disposed to be interposed between the photoconductive drum 34Y and the developing roller 84 (see FIG. 4). In contrast, in the second modified example, the fluctuation preventing members 88 are disposed to be interposed between the photoconductive drum 34Y and the developing roller side housing 70. Even in the second modified example, each fluctuation preventing member 88 is disposed at a position more distant from the developing region (the developing portion where the magnet is provided) of the developing roller 84 compared with the above exemplary embodiment.

One end portion of the main body portion 102 of each fluctuation preventing member 88 is fixed to the developing roller side housing 70, the first sliding portion 100*a* is mounted to the other end portion of the main body portion 102, and the first sliding portion 100*a* is in contact with the photoconductive drum 34Y.

In the second modified example, one end portion of each biasing member 98 is mounted to the developing roller side housing 70, the other end portion of the biasing member 98 is in contact with the image forming apparatus main body 12, and the biasing member 98 biases the developing roller side housing 70 against the photoconductive drum 34Y so that the developing roller 84 and the photoconductive drum 34Y approach each other. The other end portion of the biasing member 98 may be mounted to the image forming apparatus main body 12, and one end portion of the biasing member 98 may be in contact with the developing roller side housing 70, instead of the configuration in which one end portion of the biasing member 98 is mounted to the developing roller side housing 70, and the other end portion of the biasing member 98 is in contact with the image forming apparatus main body 12.

In the second modified example, the image forming apparatus 10 has the bearings 110, for example, which are configured in the same way as the bearings in the first modified example, and the developing roller 84 is rotatably supported by the bearings 110. In addition, the bearings 110 are fixed to the developing roller side housing 70.

Because the configurations of the second modified example, except for the above configurations, are similar to those in the above exemplary embodiment, the descriptions of parts similar to thos8e in the above-described exemplary embodiment will be omitted.

Next, a third modified example of the present invention will be described.

Figure 12:
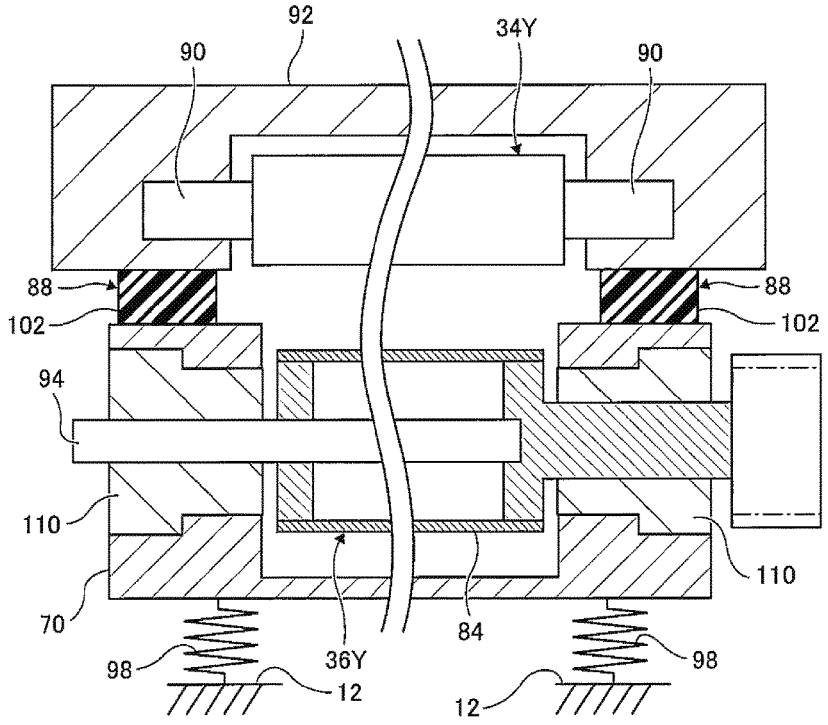
FIG. 12 is a partial cross-sectional view illustrating a relationship among an image carrier, a developing device, biasing members, and a fluctuation preventing member, which are used in a third modified example of the present invention, when viewed from the right side.

FIG. 12 is a partial cross-sectional view illustrating the photoconductive drum 34Y, the developing device 36Y, the biasing members 98, the fluctuation preventing members 88, and the like which are used in the third modified example of the present invention when viewed from the right side.

In the above exemplary embodiment, the fluctuation preventing members 88 are disposed to be interposed between the photoconductive drum 34Y and the developing roller 84 (see FIG. 4). In contrast, in the third modified example, the fluctuation preventing member 88 is disposed to be interposed between the developing roller side housing 70 and the photoconductive drum side housing 92. That is, in the third modified example, the fluctuation preventing members 88 are interposed between members (housings) fixedly disposed, and the fluctuation preventing members 88 do not slide on a rotating member such as the developing roller or the photoconductive drum.

Each fluctuation preventing member 88 has only the main body portion 102, one end portion of the main body portion 102 is fixed to the developing roller side housing 70, and the other end portion of the main body portion 102 is in contact with the photoconductive drum side housing 92.

In the third modified example, one end portion of each biasing member 98 is mounted to the developing roller side housing 70, the other end portion of the biasing member 98 is in contact with the image forming apparatus main body 12, and the biasing member 98 biases the developing roller side housing 70 against the photoconductive drum 34Y so that the developing roller 84 approaches the photoconductive drum 34Y. The other end portion of the biasing member 98 may be mounted to the image forming apparatus main body 12, and one end portion of the biasing member 98 may be in contact with the developing roller side housing 70, instead of the configuration in which one end portion of the biasing member 98 is mounted to the developing roller side housing 70, and the other end portion of the biasing member 98 is in contact with the image forming apparatus main body 12.

In the third modified example, the image forming apparatus 10 has the bearings 110, for example, which are configured in the same way as the bearings in the first modified example, and the developing roller 84 is rotatably supported by the bearings 110. In addition, the bearings 110 are fixed to the developing roller side housing 70.

Because configurations of the third modified example, except for the above configurations, are similar to those in the above exemplary embodiment, descriptions of the parts similar to those in the above exemplary embodiment will be omitted.

Next, a fourth modified example of the present invention will be described.

Figure 13:
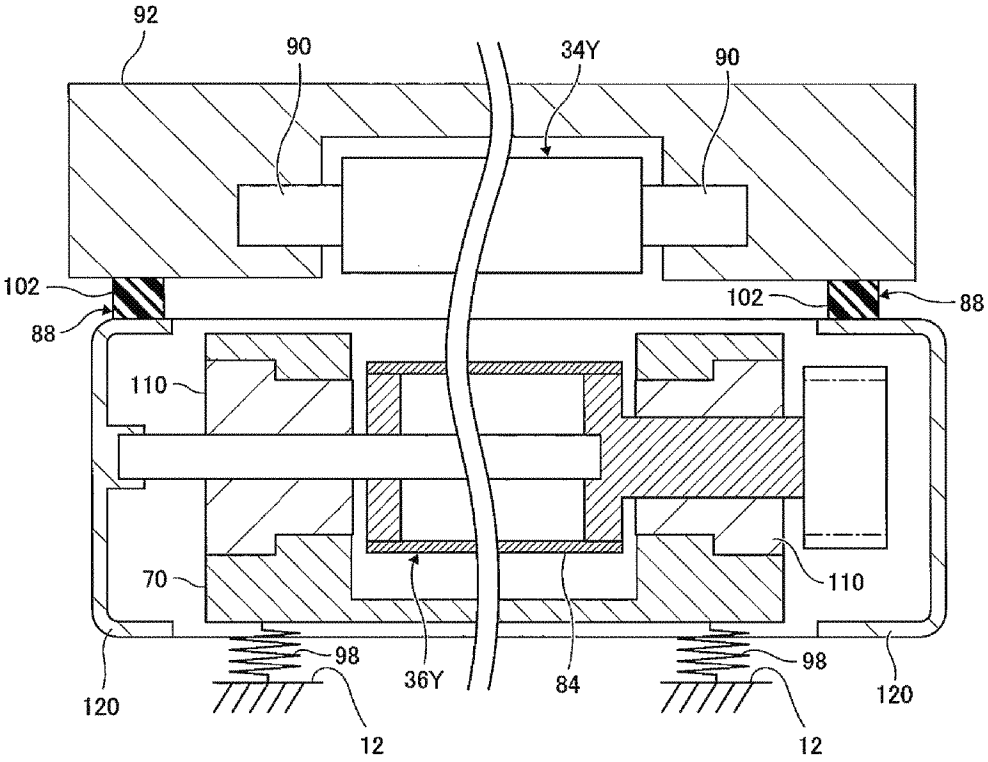
FIG. 13 is a partial cross-sectional view illustrating a relationship among an image carrier, a developing device, biasing members, and a fluctuation preventing member, which are used in a fourth modified example of the present invention, when viewed from the right side.

FIG. 13 is a partial cross-sectional view illustrating the photoconductive drum 34Y, the developing device 36Y, the biasing members 98, the fluctuation preventing members 88, and the like which are used in the fourth modified example of the present invention when viewed from the right side.

As illustrated in FIG. 13, the fourth modified example includes an exterior member 120 located on the outside of the developing roller side housing 70 and covers the developing roller 84, the developing roller side housing 70, or the like. The fluctuation preventing members 88 are disposed to be interposed between the exterior member 120 and the photoconductive drum side housing 92. As in the third modified example, in the fourth modified example, the fluctuation preventing members 88 are also interposed between members fixedly disposed, and do not slide on a rotating member such as the developing roller or the photoconductive drum.

Each fluctuation preventing member 88 has only the main body portion 102, one end portion of the main body portion 102 is fixed to the exterior member 120, and the other end portion of the main body portion 102 is in contact with the photoconductive drum side housing 92.

In the fourth modified example, one end portion of each biasing member 98 is mounted to the developing roller side housing 70, the other end portion of the biasing member 98 is in contact with the image forming apparatus main body 12, and the biasing member 98 biases all of the developing roller side housing 70, the exterior member 120, the developing roller 84, and the like against the photoconductive drum 34Y such that the developing roller 84 approaches the photoconductive drum 34Y. The other end portion of the biasing member 98 may be mounted to the image forming apparatus main body 12, and one end portion of the biasing member 98 may be in contact with the developing roller side housing 70, instead of the configuration in which one end portion of the biasing member 98 is mounted to the developing roller side housing 70, and the other end portion of the biasing member 98 is in contact with the image forming apparatus main body 12.

In the fourth modified example, the image forming apparatus 10 has the bearings 110, for example, which are configured in the same way as the bearings in the first modified example, and the developing roller 84 is rotatably supported by the bearings 110. In addition, the bearings 110 are fixed to the developing roller side housing 70.

Because configurations of the fourth modified example, except for the above configurations, are similar to those in the above exemplary embodiment, descriptions of parts similar to those in the above exemplary embodiment will be omitted.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier;

a developing roller that faces the image carrier and is configured to develop a latent image on the image carrier;

a biasing member that is provided on an outside of an end portion of the developing roller and that biases the image carrier and the developing roller in a direction where the image carrier and the developing roller approach each other; and a fluctuation preventing member that is interposed between the image carrier and the developing roller and that is configured to prevent, along with the biasing member, a fluctuation in a distance between a surface of the developing roller and a surface of the image carrier in a region where the image carrier and the developing roller face each other, wherein the fluctuation preventing member comprises:

a first sliding portion configured such that the image carrier may slide on the first sliding portion;

a second sliding portion configured such that the developing roller may slide on the second sliding portion; and a main body portion that is disposed between the first sliding portion and the second sliding portion, and wherein the main body portion is made of a material containing one selected from the group consisting of ether-based polyurethane, styrene-based thermoplastic elastomer, olefin-based thermoplastic elastomer, and urethane-based macrofoam.

2. The image forming apparatus according to claim 1, further comprising:

a housing that surrounds at least one of the image carrier and the developing roller, wherein at least one end of the fluctuation preventing member is fixed to the housing.

3. The image forming apparatus according to claim 1, wherein the fluctuation preventing member is disposed to be interposed between the image carrier and the developing roller.

4. The image forming apparatus according to claim 1, wherein the first sliding portion and the second sliding portion are made of a material containing one selected from the group consisting of polyimide, polyethylene terephthalate, polyoxymethylene resin, and polyacetal resin.

5. The image forming apparatus according to claim 1, further comprising:

a bearing that rotatably supports the developing roller, wherein the fluctuation preventing member is disposed to be interposed between the image carrier and the bearing.

6. The image forming apparatus according to claim 1, further comprising:

a developing roller side housing that surrounds the developing roller and that supports an end portion of a rotating shaft of the developing roller, wherein the fluctuation preventing member is disposed to be interposed between the image carrier and the developing roller side housing.

7. The image forming apparatus according to claim 1, further comprising:

a developing roller side housing that surrounds the developing roller; and an image carrier side housing that surrounds the image carrier, wherein the fluctuation preventing member is disposed to be interposed between the developing roller side housing and the image carrier side housing.

8. The image forming apparatus according to claim 1, further comprising:

an exterior member that surrounds the developing roller; and an image carrier side housing that surrounds the image carrier, wherein the fluctuation preventing member is disposed to be interposed between the exterior member and the image carrier side housing.

9. An image forming unit comprising:

a developing roller that faces an image carrier and that is configured to develop a latent image on the image carrier; and a fluctuation preventing member that is interposed between the image carrier and the developing roller, that is provided on an outside of an end portion of the developing roller, and that is configured to prevent a fluctuation in a distance between a surface of the developing roller and a surface of the image carrier in a region where the image carrier and the developing roller face each other, along with a biasing member that biases the image carrier and the developing roller in a direction in which the image carrier and the developing roller approach each other, wherein the fluctuation preventing member comprises:

a first sliding portion configured such that the image carrier may slide on the first sliding portion;

a second sliding portion configured such that the developing roller may slide on the second sliding portion; and a main body portion that is disposed between the first sliding portion and the second sliding portion, and wherein the main body portion is made of a material containing one selected from the group consisting of ether-based polyurethane, styrene-based thermoplastic elastomer, olefin-based thermoplastic elastomer, and urethane-based macrofoam.

10. The image forming unit according to claim 9, further comprising:

the biasing member.

11. An image forming apparatus comprising:

an image carrier;

a developing roller that faces the image carrier and is configured to develop a latent image on the image carrier;

a biasing member that is provided on an outside of an end portion of the developing roller and that biases the image carrier and the developing roller in a direction where the image carrier and the developing roller approach each other; and a fluctuation preventing member that is interposed between the image carrier and the developing roller and that is configured to prevent, along with the biasing member, a fluctuation in a distance between a surface of the developing roller and a surface of the image carrier in a region where the image carrier and the developing roller face each other, wherein the fluctuation preventing member comprises:

a first sliding portion configured such that the image carrier may slide on the first sliding portion;

wherein the first sliding portion is formed of a sheet, a second sliding portion configured such that the developing roller may slide on the second sliding portion;

wherein the second sliding portion is formed of a sheet; and a main body portion that is disposed between the first sliding portion and the second sliding portion, wherein each of the first sliding portion and the second sliding portion have a larger area than the main body portion, and wherein a material of a main body portion is different from a material of the first sliding portion and a material of the second sliding portion.

12. The image forming apparatus of claim 11, wherein opposite ends of the fluctuation preventing member in a rotation direction of the image carrier or the developing roller are fixed to side housing of the developing roller.

* * * * *